US011547163B2

(12) United States Patent
Cumiskey

(10) Patent No.: US 11,547,163 B2
(45) **Date of Patent: *Jan. 10, 2023**

(54) APPAREL FOR ATHLETIC ACTIVITIES

(71) Applicant: Under Armour, Inc., Baltimore, MD (US)

(72) Inventor: Mark Cumiskey, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 184 days.

This patent is subject to a terminal disclaimer.

(21) Appl. No.: 16/921,290

(22) Filed: Jul. 6, 2020

(65) Prior Publication Data

US 2020/0329790 A1 Oct. 22, 2020

Related U.S. Application Data

(62) Division of application No. 15/718,367, filed on Sep. 28, 2017, now Pat. No. 10,709,181.

(60) Provisional application No. 62/400,835, filed on Sep. 28, 2016.

(51) Int. Cl.
*A41D 31/14* (2019.01)
*A41D 13/00* (2006.01)
(Continued)

(52) U.S. Cl.
CPC ..... *A41D 31/145* (2019.02); *A41D 13/0015* (2013.01); *A41D 13/015* (2013.01);
(Continued)

(58) Field of Classification Search
CPC ..... A41D 13/02; A41D 31/145; A41D 31/02; A41D 31/185; A41D 31/18; A41D 13/015; A41D 27/10; A41D 2400/24; A41D 2500/52; A41D 2600/10; A41D 1/08; A41D 1/00; A41D 1/06; A41D 13/0015;
(Continued)

(56) References Cited

U.S. PATENT DOCUMENTS 1,606,899 A * 11/1926 Waldo ..... B68G 7/00 296/39.1
2,134,630 A 10/1938 French
2,285,335 A 6/1942 Hurt
2,705,687 A 4/1955 Petterson et al.
2,748,551 A 6/1956 Garbellano
(Continued)

FOREIGN PATENT DOCUMENTS

DE 2935780 A1 4/1981
EP 0962313 A1 8/1999
(Continued)

OTHER PUBLICATIONS

PCT International Search Report, PCT/US2017/053972, dated Dec. 18, 2017, 7 pages.
(Continued)

*Primary Examiner* — Amy Vanatta
(74) *Attorney, Agent, or Firm* — Edell, Shapiro & Finnan, LLC

(57) ABSTRACT

A textile laminate includes a first side, a second side, and a plurality of spaced apart marks formed on the first side. The plurality of marks formed on the first side impart a roughened, uneven surface along the second side that corresponds with the first side, and a surface roughness of the second side varies based upon a degree of stretch applied to the textile laminate.

16 Claims, 7 Drawing Sheets

(51) Int. Cl.

| | |
|---|---|
| ***A41D 13/02*** | (2006.01) |
| ***A41D 27/10*** | (2006.01) |
| ***A41D 31/02*** | (2019.01) |
| ***A41D 13/015*** | (2006.01) |
| ***A41D 31/18*** | (2019.01) |

(52) U.S. Cl.
CPC ..... *A41D 13/02* (2013.01); *A41D 27/10* (2013.01); *A41D 31/02* (2013.01); *A41D 31/185* (2019.02); *A41D 2400/24* (2013.01); *A41D 2500/52* (2013.01); *A41D 2600/10* (2013.01)

(58) Field of Classification Search
CPC ..... A41D 13/0002; A41D 27/02; A41D 2300/22; A41D 2300/20; A41D 2500/00; A41D 31/04; B32B 3/26; B32B 3/28; B32B 3/30; B32B 3/00; B32B 3/02; B32B 2260/00; B32B 5/04; B32B 2307/51; B32B 2307/746; B32B 3/10; B32B 3/14; B32B 27/40; B32B 3/08; B32B 3/085; B32B 3/16; B32B 33/00; B32B 2255/02; B32B 2307/50; B32B 2437/00; B32B 2437/02
See application file for complete search history.

(56) References Cited

U.S. PATENT DOCUMENTS

| | | | | |
|---|---|---|---|---|
| 2,749,551 | A | 6/1956 | Garbellano | |
| 2,905,947 | A | 9/1959 | Rosenberg | |
| 3,283,338 | A | 11/1966 | Lucian | |
| 3,396,406 | A | 8/1968 | Gongwer | |
| 3,673,026 | A * | 6/1972 | Brown | B31F 1/07 156/181 |
| 3,784,347 | A | 1/1974 | Robinson | |
| 3,813,697 | A | 6/1974 | Belpaume | |
| 3,835,470 | A | 9/1974 | Greiter | |
| 4,084,265 | A | 4/1978 | Anfelt | |
| 4,176,408 | A | 12/1979 | de Polo | |
| 4,179,754 | A | 12/1979 | Denu | |
| 4,268,238 | A | 5/1981 | Marc | |
| 4,306,317 | A | 12/1981 | Joseph | |
| 4,368,547 | A | 1/1983 | de Polo | |
| 4,441,876 | A | 4/1984 | Marc | |
| 4,524,037 | A | 6/1985 | Marc | |
| 4,851,167 | A | 7/1989 | Marc | |
| 4,972,522 | A | 11/1990 | Rautenberg | |
| 5,033,116 | A | 7/1991 | Itagaki et al. | |
| 5,052,053 | A | 10/1991 | Peart et al. | |
| 5,244,716 | A * | 9/1993 | Thornton | A41D 31/102 2/243.1 |
| 5,359,735 | A | 11/1994 | Stockwell | |
| 5,371,903 | A | 12/1994 | Lew | |
| 5,380,578 | A | 1/1995 | Rautenberg | |
| 5,415,924 | A | 5/1995 | Herlihy, Jr. | |
| 5,631,074 | A | 5/1997 | Herlihy, Jr. | |
| 5,734,990 | A | 4/1998 | Waring | |
| 5,809,567 | A | 9/1998 | Jacobs et al. | |
| 5,819,322 | A | 10/1998 | Dicker et al. | |
| 5,836,016 | A | 11/1998 | Jacobs et al. | |
| 5,887,280 | A | 3/1999 | Waring | |
| D409,819 | S | 5/1999 | Gilchrist | |
| 6,098,198 | A | 8/2000 | Jacobs et al. | |
| 6,343,381 | B1 | 2/2002 | Sirakova | |
| D456,110 | S | 4/2002 | Fairhurst et al. | |
| D460,242 | S | 7/2002 | Fairhurst et al. | |
| D461,033 | S | 8/2002 | Fairhurst et al. | |
| 6,430,752 | B1 | 8/2002 | Bay | |
| 6,438,755 | B1 | 8/2002 | MacDonald et al. | |
| 6,484,319 | B1 | 11/2002 | Fusco et al. | |
| 6,546,560 | B2 | 4/2003 | Fusco et al. | |
| D485,048 | S | 1/2004 | Janes | |
| D510,175 | S | 10/2005 | Ragot et al. | |
| D553,297 | S | 10/2007 | Sumpter | |
| D602,677 | S | 10/2009 | Cowan | |
| D608,981 | S | 2/2010 | Cowan | |
| 7,737,056 | B2 * | 6/2010 | Chang | D04H 1/4374 442/49 |
| 7,856,668 | B2 | 12/2010 | Demarest et al. | |
| 7,941,869 | B2 | 5/2011 | Wright et al. | |
| 8,082,595 | B2 | 12/2011 | Nordstrom | |
| 8,185,971 | B2 | 5/2012 | Wright et al. | |
| 8,286,262 | B2 | 10/2012 | Rance et al. | |
| 8,347,413 | B2 | 1/2013 | Wright et al. | |
| 8,375,465 | B2 | 2/2013 | Whaley | |
| 8,539,615 | B1 | 9/2013 | Carver | |
| 8,548,622 | B2 | 10/2013 | Berns et al. | |
| 8,745,769 | B2 | 6/2014 | Wright et al. | |
| D730,583 | S | 5/2015 | Read | |
| D774,727 | S | 12/2016 | McCombs | |
| 9,854,854 | B2 | 1/2018 | Canales et al. | |
| D824,143 | S | 7/2018 | Witherspoon et al. | |
| 10,238,156 | B2 | 3/2019 | Cumiskey et al. | |
| 10,548,358 | B2 | 2/2020 | Roberts | |
| 10,709,176 | B2 | 7/2020 | Maier | |
| 10,709,181 | B2 | 7/2020 | Cumiskey | |
| 10,729,188 | B2 | 8/2020 | Meillassoux et al. | |
| 2001/0004771 | A1 | 6/2001 | Chou | |
| 2002/0026660 | A1 | 3/2002 | Goda | |
| 2002/0152531 | A1 | 10/2002 | Fusco et al. | |
| 2006/0085889 | A1 | 4/2006 | Okajima | |
| 2006/0200890 | A1 | 9/2006 | Prat Gonzalez | |
| 2006/0277653 | A1 | 12/2006 | Okajima | |
| 2007/0144221 | A1 | 6/2007 | Sytz | |
| 2007/0293106 | A1 | 12/2007 | Harber | |
| 2008/0196136 | A1 | 2/2008 | Fellouhe et al. | |
| 2008/0078008 | A1 | 4/2008 | Demarest et al. | |
| 2008/0141431 | A1 | 6/2008 | Rance et al. | |
| 2008/0189525 | A1 | 8/2008 | Wright et al. | |
| 2009/0276936 | A1 | 11/2009 | Makida et al. | |
| 2010/0011479 | A1 | 1/2010 | Onoda | |
| 2010/0077527 | A1 | 4/2010 | Lee | |
| 2010/0299799 | A1 | 12/2010 | Belluye et al. | |
| 2011/0016602 | A1 | 1/2011 | Berns et al. | |
| 2011/0162122 | A1 | 7/2011 | Wright et al. | |
| 2011/0247129 | A1 * | 10/2011 | Ronco | A41D 13/0002 428/101 |
| 2012/0117702 | A1 | 5/2012 | King | |
| 2012/0131720 | A1 | 5/2012 | Nordstrom et al. | |
| 2012/0174282 | A1 | 7/2012 | Newton et al. | |
| 2012/0266353 | A1 | 10/2012 | Ferre | |
| 2012/0304359 | A1 | 12/2012 | Bybee et al. | |
| 2013/0034686 | A1 * | 2/2013 | Mitsuno | D04H 3/02 428/167 |
| 2013/0198926 | A1 | 8/2013 | Rod, III et al. | |
| 2013/0212767 | A1 | 8/2013 | Nordstom et al. | |
| 2013/0212769 | A1 | 8/2013 | Lubets | |
| 2013/0298306 | A1 | 11/2013 | Turner | |
| 2014/0079920 | A1 | 3/2014 | Blakely | |
| 2014/0313037 | A1 | 10/2014 | Canales et al. | |
| 2015/0218750 | A1 * | 8/2015 | Lesser | B29C 66/472 428/161 |
| 2016/0338415 | A1 | 11/2016 | Aihara | |
| 2016/0339594 | A1 * | 11/2016 | Aihara | A41D 31/14 |
| 2017/0027248 | A1 | 2/2017 | McFarlane et al. | |
| 2017/0071275 | A1 | 3/2017 | Darby | |
| 2017/0079339 | A1 | 3/2017 | Yeomans et al. | |
| 2017/0215492 | A1 | 8/2017 | Canales et al. | |
| 2017/0273377 | A1 | 9/2017 | Aihara et al. | |
| 2018/0035727 | A1 | 2/2018 | Cumiskey et al. | |
| 2019/0009496 | A1 | 1/2019 | Trouba et al. | |

FOREIGN PATENT DOCUMENTS

| | | | | |
|---|---|---|---|---|
| EP | 2394811 | A1 * | 12/2011 | B32B 3/12 |
| JP | H03137203 | A | 6/1991 | |
| JP | H03137204 | A | 6/1991 | |
| JP | 07331513 | A | 12/1995 | |
| JP | 10140407 | A * | 5/1998 | A41D 13/0015 |
| JP | H10140407 | A | 5/1998 | |

(56) References Cited

FOREIGN PATENT DOCUMENTS

| | | | |
|---|---|---|---|
| JP | H10280222 | A | 10/1998 |
| JP | 2000064107 | A | 2/2000 |
| JP | 2003105608 | A | 4/2003 |
| JP | 2006037311 | A | 2/2006 |
| NL | 198800542 | A | 10/1987 |
| NL | 1040558 | C | 6/2015 |
| RU | 2518994 | C1 | 6/2014 |
| WO | 9708966 | A1 | 3/1997 |
| WO | 0045658 | A1 | 8/2000 |
| WO | 2009133433 | A1 | 11/2009 |
| WO | 2010072811 | A1 | 7/2010 |
| WO | 2010151684 | A1 | 12/2010 |
| WO | 2011003102 | A1 | 1/2011 |
| WO | 2011146387 | A1 | 11/2011 |
| WO | 2013028370 | A1 | 2/2013 |

OTHER PUBLICATIONS

"Oilcloth" Wikipedia, https://en.wikipedia.org/wiki/Oilcloth; retrieved Nov. 21, 2019, 2 pages (2019).

Under Armour, "U.S. speedskaters looking to rebound from 2014 Olympic disappoint", article published to the internet on Feb. 2, 2018; https://www.batlimoresun.com/sports/olympics/bs-bz-under-armour-speedsking-20180130-story.html (12 pages).

"The World's Fastest Speedskating Suite Has Lockheed Martin DNA", published to the internet on Jan. 16, 2020, https://gizmodo.com/under-armour-will-debut-the-worlds-fastest-speedskatin-1502673088, 5 pages.

Supplementary European Search Report, EP17857407, 8 pages, dated Jun. 17, 2020.

* cited by examiner

APPAREL FOR ATHLETIC ACTIVITIES

CROSS-REFERENCE TO RELATED APPLICATIONS

This application is a divisional of U.S. patent application Ser. No. 15/718,367, filed Sep. 28, 2017 and entitled "Apparel for Athletic Activities", which is a nonprovisional of U.S. Provisional Patent Application Ser. No. 62/400,835, filed Sep. 28, 2016 and entitled "Suit for Athletic Activities," the disclosures of which are incorporated herein by reference in their entireties.

FIELD

The present invention relates to an article of apparel for athletic activity and, in particular to a suit for athletic competitions such as a speed skating suit.

BACKGROUND

Racing competitions for human athletes, in particular speed skating competitions (e.g., at an elite level), typically include gear designed for optimum performance by the athlete. Suits and other apparel associated with a particular racing sport are designed to reduce drag on the athlete. For example, in speed skating sports as well as other sports in which an athlete is moving at a rapid speed within an environment, suits are typically worn by athletes that adhere tightly and conform to the profile of an athlete's body so as to provide a streamlined contour as the athlete moves through the air or other fluid environment of a racing competition.

When performing at an ultra-elite level (e.g., competitions between the best and fastest athletes world-wide, such as an Olympic event), any feature that can reduce wind resistance and drag reduction on an athlete can enhance the athlete's performance in a racing event (e.g., increasing the athlete's speed and performance during the event, reducing the athlete's event time by fractions of seconds, etc.).

Accordingly, it would be desirable to provide a racing suit that enhances drag reduction and when worn by an athlete so as to improve the athlete's performance in a racing event.

SUMMARY

An article of apparel for athletic activities includes a resilient substrate with dynamic elements or areas selectively activated by placing the substrate under a predetermined load or tension. The dynamic elements are configured to alter the surface topography and/or surface roughness of the resilient substrate as the tension/load on the substrate changes. In an embodiment, the resilient substrate is a textile laminate including a fabric layer in contact with polymer membrane and discrete marks applied to the fabric layer. Each mark forms a corresponding recess on the polymer membrane. As the substrate is placed under tension, the dynamic elements undergo inversion, converting from a recess to a protrusion that extends from the polymer layer surface.

By way of specific example, the article of apparel is a bodysuit having a torso section, two arm sections extending from an upper portion of the torso section, and two leg sections extending from a lower portion of the torso section. An array of marks is applied the interior surface of the suit thereby imparting a roughened, uneven topography to the exterior surface of the suit. The resulting surface is effective at reducing the drag experienced by the wearer of the bodysuit during use.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION

Figure 1:
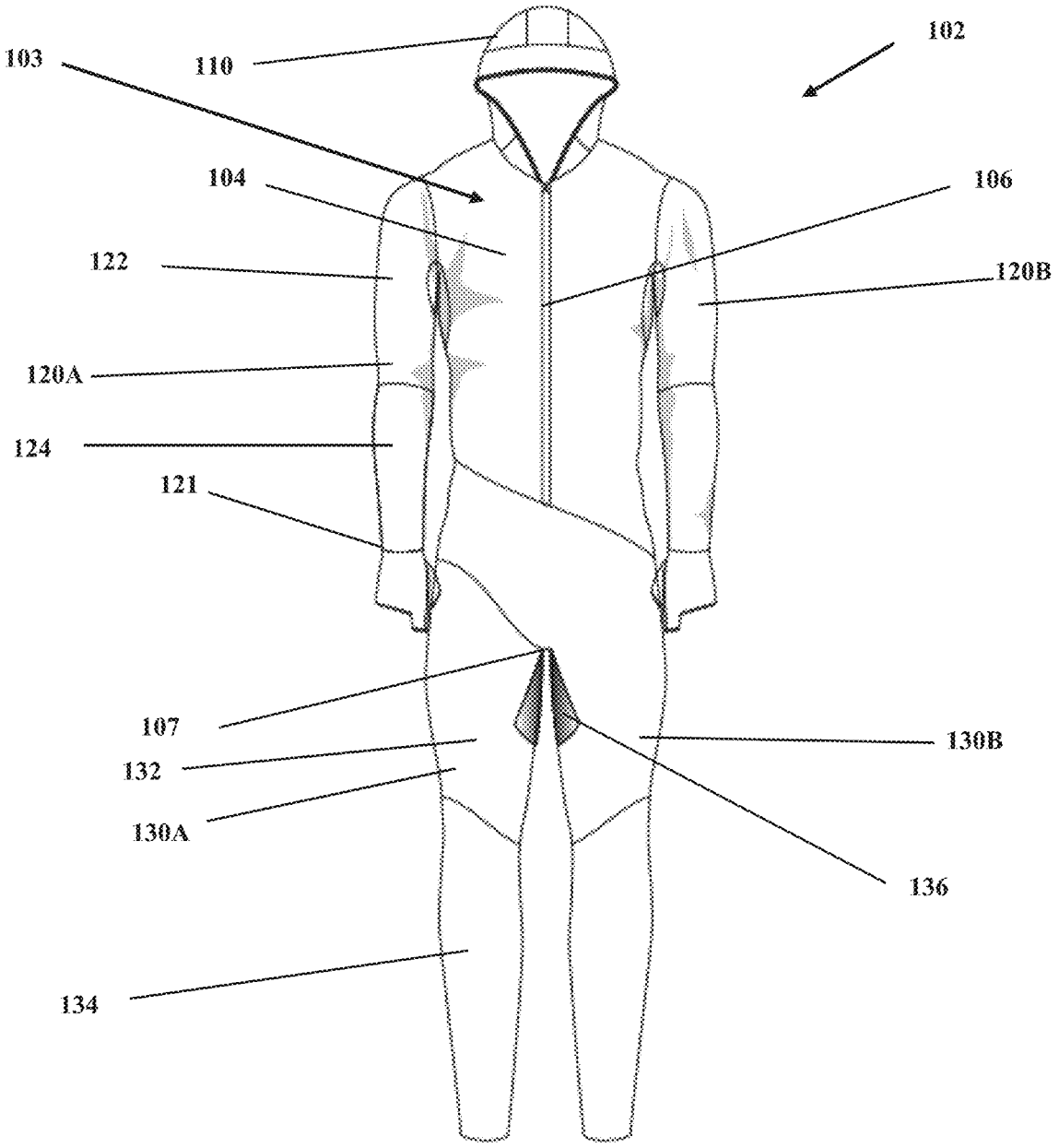
FIG. 1 is a front view of an example embodiment of a speed skating suit worn by a user in accordance with the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As described herein, an article of apparel or garment for athletic activities may be in the form of a suit including a main body or torso, arm sleeves, leg sleeves, and a hood extending from the torso section. The suit includes wind resistance or drag reduction features provided at suitable locations along portions of the suit to enhance user performance during the activities. In particular, the suit as described herein includes a roughened, uneven exterior surface (e.g., in the form of a plurality of bumps or protrusions defined along one or more exterior surface portions of the suit) that reduces drag on a user wearing the suit during an athletic activity. As described herein, the roughened, uneven exterior surface of the suit is provided or caused by marks or protrusions that are provided on an interior surface of the suit.

Figure 2:
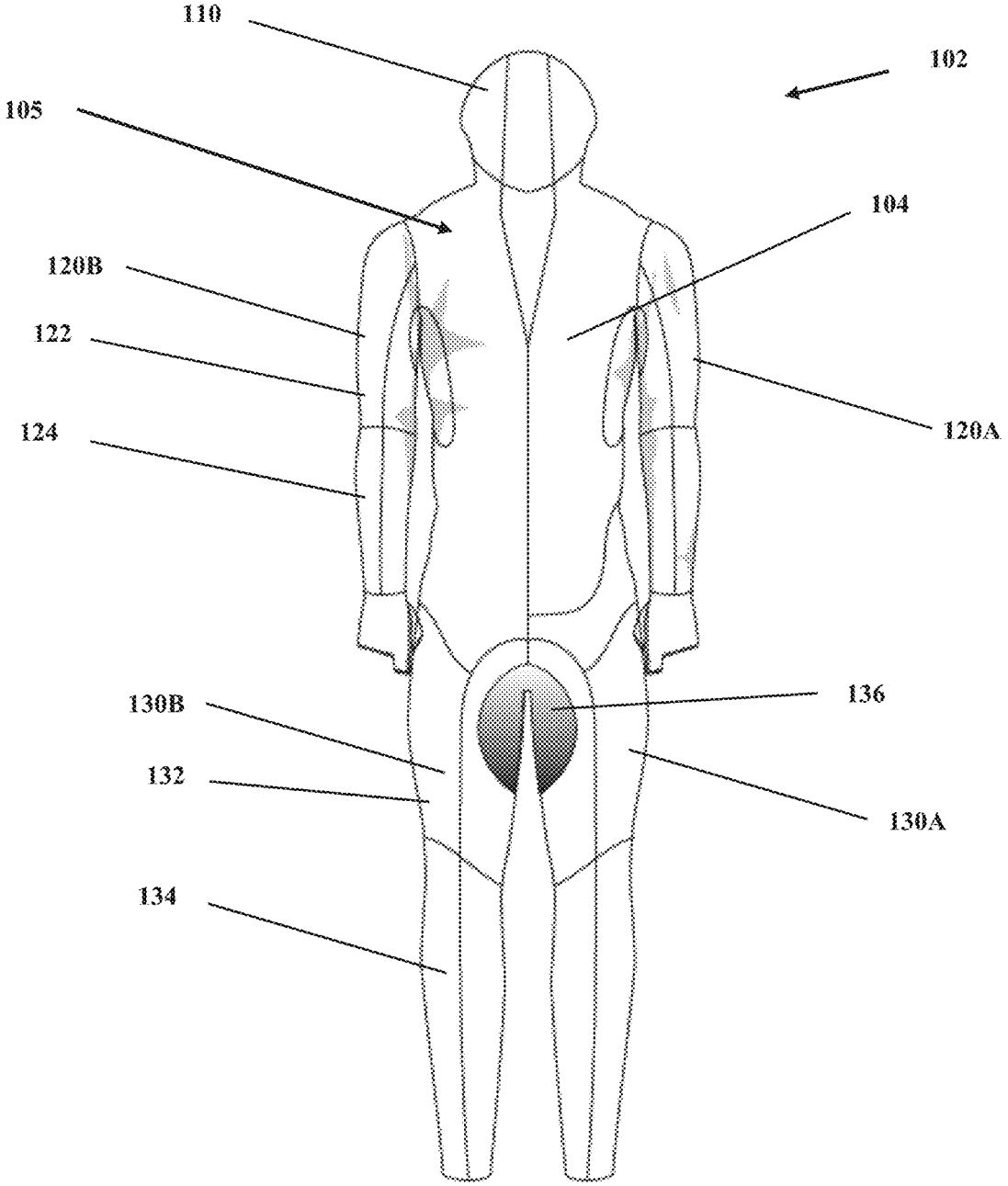
FIG. 2 is a rear view of the suit worn by the user of FIG. 1.

An example embodiment of an article of apparel or garment in accordance with the present invention is described with reference to FIGS. 1 and 2. As illustrated, the garment is in the form of a full body suit such as a speed skating suit 102. The speed skating suit 102 includes a main body or torso 104, a head covering or hood 110, a first or right arm sleeve 120A, a second or left arm sleeve 120B, a first or right leg sleeve 130A, and a second or left leg sleeve 130B. The hood 110, arm sleeves 120A, 120B and leg sleeves 130A, 130B are coupled with the torso 104 in a suitable alignment and suitably dimensioned so as to fit comfortably over while conforming to corresponding portions of the user's body (e.g., the user's head, arms and legs). With this configuration, the suit 102 defines a front suit side 103 (FIG. 1) and a rear suit side 105 (FIG. 2). A suitable fastener 106, such as a zipper structure, is provided on the front side 103 and extends from an upper portion of the torso 104 near the hood 110 to a lower portion of the torso 104 at a suitable location above the crotch region 107 so as to facilitate separation of left and right portions of the torso 104 when a user is putting on or taking off the suit 102.

The suit 102 covers a significant portion of the user's body (as shown, e.g., in FIG. 1), leaving only portions of the user's hands, feet and/or face exposed. In particular, the torso 104 generally covers the trunk of the user. The head covering 110 may be in the form of a hood that covers the crown, back, nape, and ears of the user. When worn, the suit 102 provides a generally contoured fit over portions of the user's body. In particular, the torso 104 covers the user's torso or main body portion, and the hood 110 provides a covering for a portion of the user's head, while leaving the user's face including chin and, optionally, a part of the user's neck exposed. Each leg sleeve 130A, 130B extends over a corresponding leg of the user from the user's trunk to a location below the knee (e.g., proximate the user's ankle). Each arm sleeve 120A, 120B extends over a corresponding arm of the user from the user's trunk to the user's corresponding hand to define an upper sleeve portion 122 and a lower sleeve portion 124.

Each arm sleeve 120A, 120B is a generally cylindrical tube tapering in diameter toward the arm sleeve distal end, where the arm sleeves can be constructed of the same or different materials at different locations along the arm sleeve. Each arm sleeve 120A, 120B can terminate in an end 121 that is located at or near the wrist of the wearer or user. In other embodiments, the terminal end 121 of each sleeve 120A, 120B can extend beyond the user's wrist to terminate in a glove-like configuration that extends over portions of some of the digits of the user's hand while including one or more openings that allow exposure of the terminal end(s) of one or more digits of the user's hand. Similarly, each leg sleeve 130A, 130B is a generally cylindrical tube tapering in diameter toward the leg sleeve distal end, where each leg sleeve is further of sufficient length to extend beyond the knee of the user, terminating at or near the user's ankle.

Each leg sleeve 130A, 130B can further include an inner thigh region 136 that extends toward the crotch of the suit 102 and includes a slippery or low friction material on the exterior of the inner thigh regions 136 that reduces or eliminates friction between the two inner thigh regions during athletic movements by the user (e.g., during rapid movements of the user's thighs in opposing directions when the user is engaging in a skating activity). The inner thigh regions 136 including the slippery or low friction material can extend around to cover portions of both the front side 103 and rear side 105 of the suit (as depicted in FIGS. 1 and 2). The low friction area between the corresponding inner thigh regions is such that the coefficient of friction due to contact between these two regions during user movements is low. In an example embodiment, the low friction material of the inner thigh regions 136 may be a stretch overlay film formed of elastomeric polyurethane that is commercially available, e.g., from Bemis Associates Inc. (Massachusetts, USA).

Figure 3A:
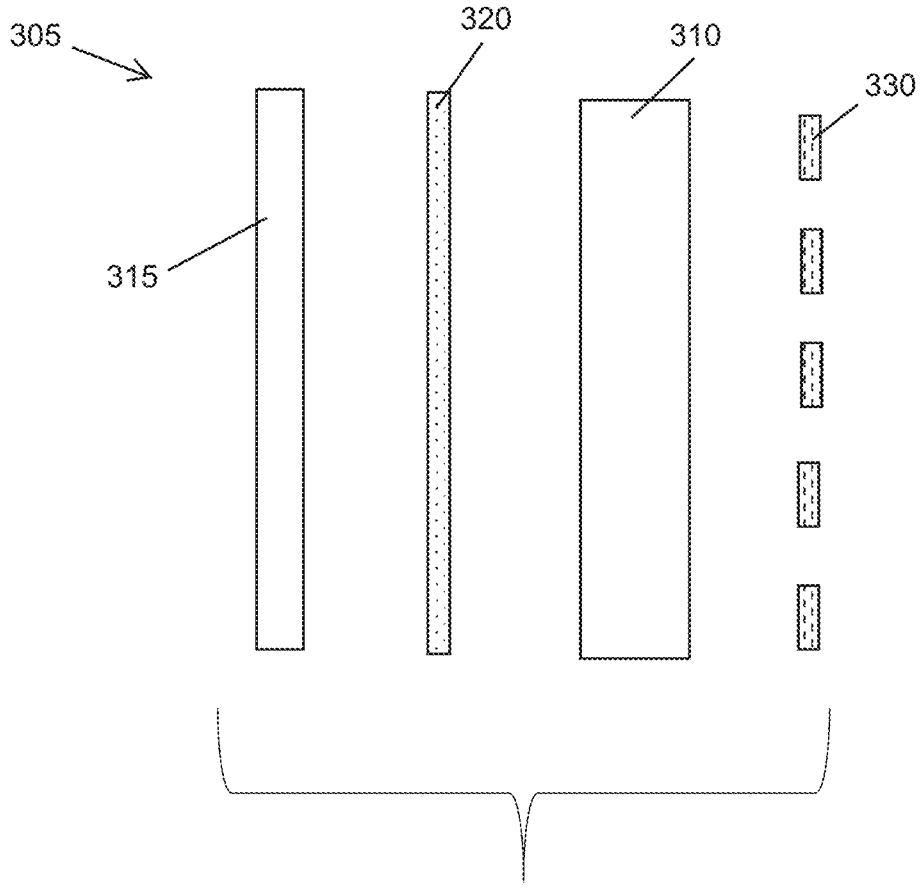
FIG. 3A is a schematic of a textile laminate in accordance with an embodiment of the invention.

The garment (i.e., each section 104, 110, 120A, 120B, 130A, 130B) is generally formed of one or more resilient textile materials operable to conform to the contours of the user's body. That is, the sections of the suit 102 can be constructed of any suitable fabric or other materials that have elastic and body conforming characteristics as well as other aerodynamic characteristics as described herein. Specifically, at least some portions of the garment (e.g., the torso section and portions of the arm and/or leg sections) is formed of a resilient substrate including one or more dynamic elements or areas operable move from a first position or configuration to a second position or configuration when a predetermined amount of force or tension is applied to the substrate. Referring to FIG. 3A, the resilient substrate is a resilient textile laminate 305 including a first or inner (e.g., innermost or user-facing) fabric layer 310 and a second or outer (e.g., outermost or exterior) film layer or membrane 315. The fabric layer 310 is an air permeable and/or vapor permeable fabric such as knit fabric (e.g., circular knit) formed of synthetic strands (e.g., polyester, nylon, and/or elastane) arranged in looped courses. The membrane 315, in contrast, is substantially or completely air and/or vapor impermeable, and may be provided in the form of a continuous polymer film (e.g., a resilient polymer such as polyurethane) secured to the inner fabric layer. The layers 310, 315 may be formed individually and then secured together utilizing an adhesive 320 (e.g., polyurethane adhesive) applied, e.g., as a continuous coating between the layers (discussed in greater detail, below).

The overall thickness of the textile laminate structure 305 can be in the range from about 0.35 mm (millimeters) to about 0.55 mm. In an embodiment, the thickness of the fabric layer 310 is generally greater than the thickness of the membrane layer 315. By way of example, the thickness of the membrane 315 (e.g., polyurethane layer) is approximately 5 microns (micrometers) to approximately 20 microns (e.g., about 12 microns to about 15 microns), while the thickness of the membrane 310 is approximately 330 microns to approximately 550 microns.

Figure 3B:
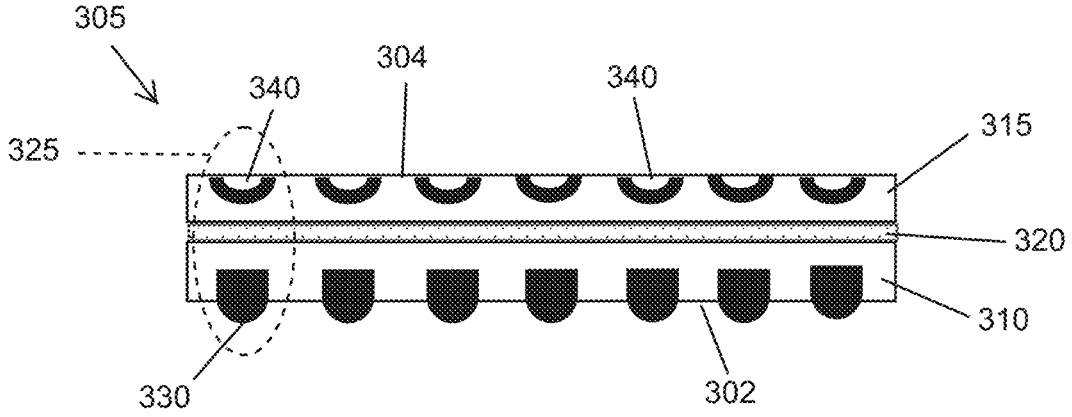
FIG. 3B is a schematic of a textile laminate of FIG. 4A in a relaxed state in which the textile laminate is not stretched and/or not worn by the user.

The dynamic elements are discrete structures or areas within the textile laminate 305 capable of affecting the topography and/or surface roughness of the membrane 315 when a load, force, or tension of a predetermined value is applied to the textile laminate in a predetermined direction. As seen in FIGS. 3A-3B, the dynamic elements 325 are formed by applying an array of marks 330 at selected locations along the surface of the fabric layer 320 (e.g., the inner surface opposite the surface facing the membrane). The marks 330 are formed of a mark composition including a binder and a ceramic particles. The binder may be a polymer such as elastomeric polymers (polyurethane) and thermosetting polymers. By way of example, the binder may comprise one or more polymers from the group of polyurethane, polyacrylate, styrene-butadiene, silicone, siloxane, sol gels, polyvinyl chloride, ethyl vinyl acetate, epoxy and polyester resins. Examples of suitable ceramic materials include one or more of silicon oxides (e.g., SiO2), zirconium oxides (e.g., ZrO2), titanium oxides (e.g., TiO2), aluminum oxides (e.g., Al2O3), magnesium oxides (e.g., MgO), yttrium oxide (Y2O3), zirconium carbide (ZrC), titanium carbide (TiC), etc. In an embodiment, the mark composition is a ceramic coating material commercially available under the tradename ENERGEAR (Schoeller Textile AG, Switzerland).

The mark composition may be applied utilizing conventional coating processes. In particular, the mark composition may be applied via a printing process such as screen printing. For example, a suitable mark composition (e.g., a ceramic ink) can applied in a selected pattern along the fabric layer 310, followed by sufficient heating to dry and solidify the composition to form the marks 330. The ceramic ink application and/or the heat treatment applied to form the marks can result in some absorption of the ink into the fabric layer and/or a slight local shrinkage of the fabric layer directly beneath each mark (e.g., during the heating process). This can result in the concavity/dimple effect along the exposed surface 304 of the membrane 315, where portions of the fabric layer 310 and the membrane 315 located directly beneath the marks are drawn closer toward the marks and/or slightly compressed in thickness so as to define indentations 340 along membrane exterior surface 304.

Each mark 330 deposited onto the fabric layer 310 is capable of generating a recess or indentation 340 along the surface of the membrane 315. While not being limited to a particular theory, it is believed that the cured/hardened mark composition, while resilient (possessing a degree of elongation and/or stretchability), possesses a lower modulus (degree of elongation) compared to the fabric layer 310 when subject to the same load/tension. Accordingly, the marks 330 generally limit the degree of elongation or stretchability of each layer of the textile laminate 305 when subjected to a stretching force. Referring to FIG. 3B, when the marks are deposited onto to the fabric layer 310, the marks 330 (via the mark composition) draw in and lock the strands forming the fabric. It is believed this localized contraction of the fabric generates a recess or indentation (also called a dimple) along the fabric surface that faces the membrane 315 which, in turn, forms a recesses or dimple 340 along the surface of the membrane at a load or tension applied to the textile laminate falls below a threshold value (e.g., when no tension is applied to the fabric). The resulting shape of the recess 340 along the membrane 315 corresponds to the shape of the mark 330 applied to the fabric layer 310. The shape of the recess 340 (or mark 330) is not limited and may include polygons and rounded shapes (circles, ovals, etc.). For example, when the mark 330 is provided as a rounded shape such as a circle, the resulting recess 340 is a convex cavity formed on membrane surface.

Figure 3C:
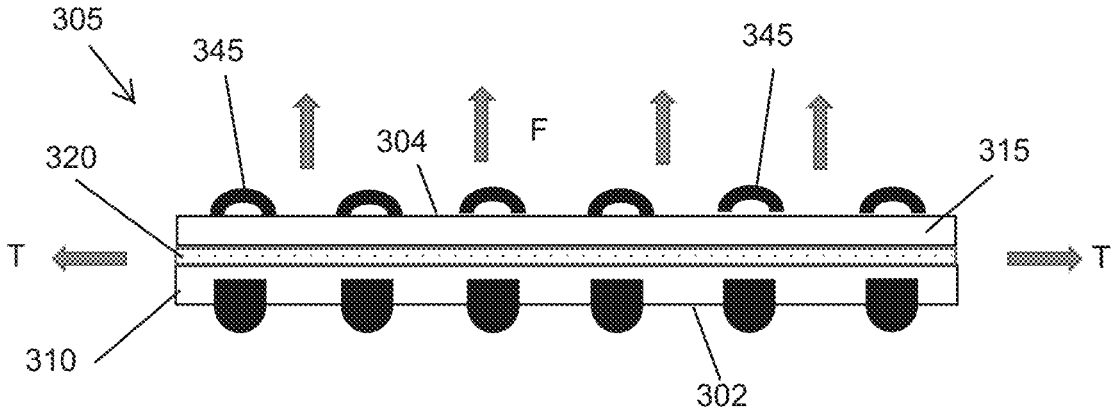
FIG. 3C is a schematic of a textile laminate of FIG. 4A in a state in which a tension, load or force is applied to the textile laminate.

In addition, the dynamic elements 325 are configured such that when a predetermined amount of force, tension, and/or load is applied to the fabric (e.g., when the fabric is stretched to a predetermined degree of stretch), the dynamic elements move from a first position or configuration to a second position or configuration. By way of example, in the first position, the dynamic elements may form the recesses 340 described above. In the second position, the dynamic elements form protrusions or bumps 345 protruding from membrane surface. Specifically, the textile laminate 305 begins in its normal or unstretched state as shown in FIG. 3B. In FIG. 3C, the textile laminate 305 is placed under tension as indicated by arrows T. The resulting force (indicated by arrow F) causes inversion within the dynamic elements, with the recesses 340 defined along the exterior surface 304 of the membrane 315 transitioning to protrusions or bumps 345.

The tension, load or force applied to the textile laminate 305 may include stretching forces applied in the two-dimensional surface or X and Y directions of the textile laminate, e.g., such as that which occurs when the suit is worn by the user. As noted above, it is believed the marks 330 possess a different degree of stretchability (i.e., ability to stretch) in comparison to the materials forming the fabric layer 310 and membrane 315. Thus, as the textile laminate 305 is stretched in different directions (e.g., in X and Y directions), the marks 330 exhibit little or no stretch while the fabric layer 310 and membrane 315 exhibit some degree of stretch (i.e., the fabric and membrane layers stretch to a much greater degree of elongation in relation to the marks 330 formed on the fabric interior surface 302), and this effect can contribute to the inversion of the recesses 340, creating a "popping" effect in which exterior surface recesses or dimples are converted to protrusions (e.g., when rounded, the dynamic elements switch from being generally concave to being generally convex).

It is further believed that the textile laminate 305 can also be stretched in directions transverse both the X and Y directions, also referred to as the Z direction, e.g., when the textile laminate 305 (the marks 330) is pressed against a surface (e.g., the user's body). This pressure forces the marks and underlying portions of the fabric layer 310 outward, away from the surface (the user's body). Even when stretching in the X and Y directions is sufficient to generate inversion of the dynamic elements 325, the pressure applied in the Z direction may exacerbate the effect. In particular, when the suit 102 portions formed of the textile laminate 305 conforms in a snug manner to the user's body such that stretching forces are applied to the suit in a Z direction that is transverse the X and Y directions of the suit interior surface, the marks 330 (which may extend outward from the interior surface 302) can force the exterior surface protrusions 345 to extend outward even further in relation to when the textile laminate is stretched only in X and Y directions. Thus, the marks 330 can contribute to stretching of the suit in three (X, Y and Z) dimensions.

When incorporated into an article of apparel such as the speed skating suit 102, the textile laminate 305 including dynamic elements 325 provides a lightweight, integrated system for selectively altering the surface roughness of one or more areas of the apparel's outer surface. Where the user is traveling through a fluid medium such as air, certain speeds of the user (in combination with the other factors associated with Re) can result in a critical or transition range between laminar and turbulent flow of fluid around the user. For example, a speed skater wearing apparel in accordance with the present invention may travel within a typical air environment at speeds ranging from about 20 miles per hour (MPH) to about 50 MPH (e.g., 30 MPH), and these speeds are within a velocity range where fluid flows around at least some portions of the user's body may transition between laminar and turbulent. By increasing the surface roughness of the exterior surface of the suit, fluid flows that might otherwise be laminar will transition to turbulent within the boundary layer at the surfaces of such body portions which results in a further overall drag reduction (i.e., enhanced aerodynamic properties imparted) for the user moving through the fluid medium such as air. Conventional speed skating suits seek to increase surface roughness of the garment by apply texture onto the exterior surface of the garment in order to trip air flow so as to reduce drag. For example, nodules or discs of silicone are applied (e.g., via printing or flow molding) to the garment outer surface such that they protrude from the surface. While effective for tripping airflow, this approach potentially increases the weight of the garment, as well as increases the risk of snagging the garment on objects within the environment.

In contrast, the described suit integrates the surface roughness into the structure of the textile laminate by applying marks 330 (e.g., via screen or gravure printing) onto the interior surface of the laminate (with the marks being generally flush with the fabric surface). In this manner, the dynamic elements 325 are integrated into the suit at selected suit locations. When present, the textile laminate 305 is configured such that the fabric layer 310 printed with the marks 330 forms the lining of the suit, which faces the wearer. The membrane layer 310 is the outer shell of the suit, being positioned and facing away from the wearer. Thus, stretching of the suit 102 (e.g., when being worn by a user) causes a change in surface texture (e.g., an increase in exterior surface roughness) of the outer shell of the suit to impart drag resistance and/or other desirable aerodynamic features of the suit during use.

Figure 4A:
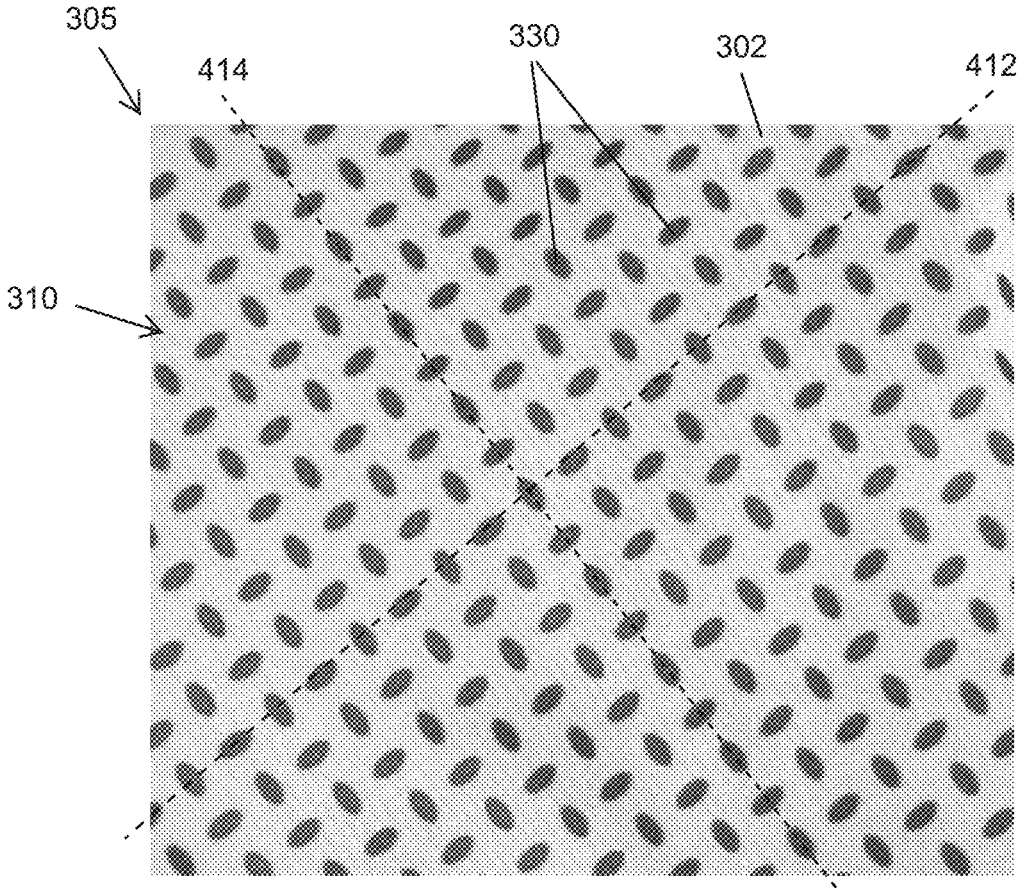
FIG. 4A is a partial view of an interior surface of the suit of FIG. 1.

Referring to FIG. 4A, the interior surface 302 of the suit 102 (the surface of the lining defined by fabric layer 310) includes the plurality of marks 330 applied (e.g., screen printed) in an array or pattern. The marks 330 can have any one or more suitable sizes, shapes, and/or thicknesses and can further be arranged along the interior surface 405 at any suitable distances or spacings from each other so as to define an areal or two dimensional "dot" density of marks (i.e., a number of marks in a given area) along the interior fabric surface 302.

The areal density or number of marks in a given area can be the same or can differ at different locations along the suit interior surface. The areal density or coverage of marks 330 formed on the interior surface 302 can be configured such that the surface area coverage is at least about 10% of any defined area (i.e., at least about 10% of a defined area is covered by the material forming the marks), preferably the surface area coverage is at least about 10% and no greater than about 50% of any defined area of the suit. In an example embodiment, the surface area coverage of material forming marks 330 on the interior surface 302 is from about 40% to about 45% (e.g., about 44%) of a defined area. In the example embodiment depicted in the figures, the surface area coverage of marks 330 is the same or substantially similar over the portions in which the marks are formed. In alternative embodiments, the surface area coverage of marks 330 can differ or vary in different locations where the marks are formed.

In the embodiment depicted in the figures, the marks 330 have the same or similar generally elongated round or elliptical shape. The marks 330 are further arranged in a pattern or grid such that a first set of marks 330 extends in a plurality of first linear directions that are generally parallel with each other (as indicated by dashed line 412 along one of the first linear directions in FIG. 4A), where each mark is further aligned along its length dimension in the first linear direction. The pattern or grid further includes a second set of marks that extend in a plurality of second linear directions that are generally parallel with each other (as indicated by dashed line 414 along one of the second linear directions in FIG. 4A), where each mark 330 is further aligned along its length dimension in the second linear direction. The pattern of marks 330 is configured such that the first linear directions are transverse (e.g., orthogonal) to the second linear directions so as to intersect with each other, resulting in the nearest neighboring marks along a first linear direction in the first set being separated by a protrusion aligned along a second linear direction in the second set and vice versa.

To state another way, the pattern or grid of marks 330 along each linear direction 412, 414 are arranged such that each mark located along a linear direction is oriented with its lengthwise dimension being transverse (e.g., orthogonal) to the lengthwise dimension of each of the previous and successive marks 330 along the same linear direction (i.e., a mark is rotated 90 degrees relative to an adjacent mark, with one mark pointing North/South and one mark pointing East/West). This pattern or grid provides a suitable distribution of marks 330 along the interior surface 302, with a generally constant spacing between each mark 330 and the nearest neighboring marks. However, any other suitable pattern of marks can also be formed on the interior surface 302.

The marks 330 can be provided at any one or more suitable locations along the interior surface of the suit 102. Referring again to FIGS. 1 and 2, the suit 102 includes a two layer structure at the torso 104 and portions of the arm sections 120 and leg sections 130. In particular, an upper portion 122 of each arm sleeve 120A, 120B extending from the torso 104 (e.g., a portion extending from the user's shoulder to at or slightly above or below the user's elbow) is formed of the textile laminate 305, while the lower portion 124 of each arm sleeve (e.g., extending from the upper portion 122 to the user's wrist or part of the user's hand) is formed of a single layer structure comprising a knitted stretch fabric structure. Similarly, an upper portion 132 of each leg sleeve 130A, 130B extending from the torso 104 and hip region (e.g., a portion extending from the user's hip to at or slightly above or below the user's knee) is formed of the textile laminate 305, and a lower portion 134 of each leg sleeve (e.g., a portion that extends from the upper portion 133 to the user's ankle) is formed of a single layer structure comprising a knitted stretch fabric structure. Thus, the textile laminate forms the torso and hip regions of the suit and extends in a continuous (i.e., non-interrupted) manner to portions of the arm and leg sleeves. However, it is noted that, in alternative embodiments, the marks can also be provided at other interior surface locations of the suit, such as locations including only a single layer (e.g., a fabric layer).

With this configuration, as portions of the suit 102 are stretched to a sufficient degree, the pattern of marks 330 provided on one or more interior surface portions of the suit 102 impart an uneven (non-flat), undulating or roughened texture to corresponding exterior surface portions of the exterior surface of the suit, where the uneven or roughened exterior surface enhances the aerodynamic features of the suit which can in turn enhance the racing performance or speed of the user wearing the suit when moving through air or other fluid medium.

Figure 4B:
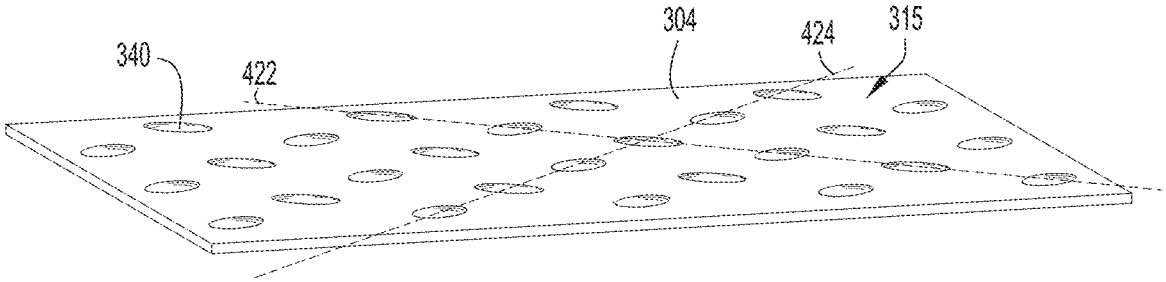
FIG. 4B is a partial view in perspective of an exterior surface of the suit of FIG. 1 in a relaxed state in which the suit is not stretched and/or not worn by the user, where the exterior surface is shown in isolation.

For example, as depicted in FIG. 4B, showing a portion of the exterior surface 304 of the suit (as defined by membrane 315, where the membrane 315 is shown by itself or in isolation for ease of illustration) in a relaxed or un-stretched state, the marks 330 formed on interior surface 302 of the suit 102 impart slight recesses 340 or a dimple effect on the corresponding exterior surface 304 of the suit 102. In particular, the exterior surface 304 of the suit 102 (defined by membrane 315) has dimples, concavities or indentations 340 defined thereon which are directly above and directly correspond with the locations of the marks 330 formed on the suit interior surface 302 (FIG. 3A). This "dimple" effect on the suit exterior surface 304 is present when the suit 102 is in a relaxed or un-stretched state, such as when the suit is not being worn by the user. Thus, the "dimple" effect results in an uneven surface texture over exterior surface portions of the suit 102 corresponding with the marks 310 provided on the suit interior surface.

The exterior surface 304 of the suit 102 becomes roughened further upon stretching because protrusions or bumps may be imparted along the exterior surface in response to the suit being stretched a sufficient amount or to a sufficient degree, such as when the suit is worn by the user. As previously noted, the textile laminate 305 forming portions of the suit 102 is configured to have a sufficient degree of stretch in one or more directions (e.g., two or four way stretch) so as to provide a tight or snug fit when worn by the user so as to conform to the contour of the user's body. Thus, portions of the suit 102 are stretched from a relaxed state when not worn by a user to a stretched state when the suit is worn by the user. The stretching of the suit 102 at the location of the marks 330 on the suit interior surface 302 results in protrusions 345 being defined along the suit exterior surface 304 (as depicted by a portion of the isolated view of the membrane 315 in FIG. 4C, where the suit is in a stretched/worn state) that correspond with the interior surface marks 330. The protrusions 345 are essentially raised portions of the exterior surface 304 (e.g., convex undulations along the exterior surface) of the substantially air impermeable layer (i.e., the membrane 315), which are formed or defined at the same locations as the marks 330 printed (or formed in any other suitable manner) by a ceramic or other material applied to the interior surface 302.

Figure 4C:
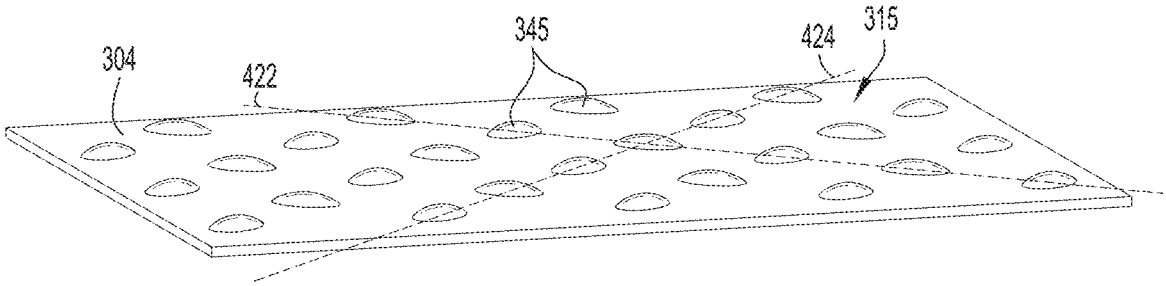
FIG. 4C is a partial view in perspective of the exterior surface of the suit of FIG. 1 in a state in which the suit is stretched and/or worn by the user, where the exterior surface is shown in isolation.

Stated another way, the marks 330 provided on the interior surface 302 of the suit 102 (i.e., the interior surface of the fabric layer 310 forming the textile laminate 305) in essence impart or cause corresponding dimples or indentations 340 to form on the exterior surface 304 of the suit (i.e., along the membrane 315 forming the textile laminate) when the suit is in a relaxed state, and the same marks 330 further impart or cause corresponding outward bumps or protrusions 345 to form along the exterior surface 304 when the suit is stretched at the location of the marks 330 (e.g., when the suit is worn by the user). In particular, an outward protrusion or "popping" effect occurs at exterior surface portions of the suit 102 when the suit is stretched, where the dimples or indentations 330 on the suit exterior surface 304 are converted to the bumps or protrusions 345 at the same locations of the suit exterior surface 304 when the suit transitions from a relaxed or unstretched (e.g., unworn) state to a stretched (e.g., worn) state. As depicted in FIGS. 4B and 4C, the exterior surface dimples 330 and protrusions 345 generally conform in both size (e.g., length, width and/or diameter dimensions), shape and pattern arrangement as the interior surface marks 330 (the protrusions may possess slightly larger dimensions in light of the stretching of the textile laminate 305). The same or similar grid pattern arrangement of the protrusions 345 that corresponds with the grid pattern arrangement of the interior surface marks 330 is indicated by the dashed lines 422, 424 shown in FIGS. 4B and 4C (where the dashed lines 422, 424 represent linearly arranged sets of protrusions 345 arranged such that each protrusion located along a linear direction is oriented with its lengthwise dimension being transverse (e.g., orthogonal) to the lengthwise dimension of each of the previous and successive protrusions along the same linear direction).

With the above described configuration, the suit 102 can have a varying degree of roughness along its exterior surface that is influenced or controlled based upon a number of different factors associated with the suit. One factor is the degree of stretch applied to the suit 102 and, in particular, to the textile laminate 305. For example, the suit 102 can have a first degree of roughness along the exterior surface 304 when in the relaxed state (e.g., when the exterior surface exhibits a dimple effect with indentations 330 defined along the exterior surface 304) and also a second degree of roughness along the exterior surface of the suit when in a stretched state such as when the suit is worn by a user (e.g., when the exterior surface exhibits protrusions 345 defined along exterior surface 304). The second degree of roughness (protrusions defined on suit exterior surface) can be greater than the first degree of roughness (indentations defined on suit exterior surface). The degree of roughness can be determined, e.g., based upon a surface roughness caused by the surface texture along the suit exterior surface, where a relatively smooth surface, or a relatively smooth surface having dimples or depressions, has a degree of roughness that is less than a surface having an uneven contour with convex bumps or protrusions located along the surface. The degree of roughness can also be determined in relation to a coefficient of friction along the surface, where rougher surfaces (e.g., surfaces having outwardly extending bumps or protrusions) have higher friction coefficients in relation to smoother surfaces (e.g., relatively flat or even surfaces and/or surfaces having dimples or indentations).

A suitable degree of roughness on exterior surface portions of the suit can be achieved when one or more portions of the suit are stretched to a sufficient degree of stretch or elongation. The degree of stretch can be determined, e.g., by a percentage or degree of elongation along a dimension of the textile laminate 305 forming the suit, where degree of elongation=(stretched dimension−original dimension)/original dimension×100. The suit 102 (i.e., of the textile laminate 205) may possess a degree of elongation that ranges from about 5% to about 50% (e.g., at least about 20%), with activation (inversion) of the dynamic elements occurring within this degree of stretch. For example, the suit 102 (i.e., the textile laminate 305) can be configured such that one or more layers of the suit have a degree of elongation in the length dimension of the suit of about 45% to about 55% (e.g., about 50%) and a degree of elongation in the width dimension of the suit of about 35% to about 45% (e.g., about 40%).

The exterior membrane surface 304 dimple and/or bump effect caused by the interior surface marks 330 can be imparted to the suit based, at least in part, upon the method in which the marks 330 are applied to the fabric interior surface 302. In an example embodiment, the portions of the suit 102 that include the two-layer structure of the textile laminate 305 can be formed by first laminating a polyurethane layer (e.g., layer 315) to one surface of a fabric layer (e.g., layer 310), where the fabric layer forms the interior layer while the polyurethane laminate film layer forms the exterior layer of the suit 102. A polyurethane or other suitable adhesive (e.g., adhesive 320) can be used to laminate the polyurethane film layer to the fabric layer. Next, marks 330 are formed on the user-facing surface of the fabric layer 310 to form the integrated dynamic elements 325 functioning as described above.

As noted above, the marks 330 can be formed on the of suit interior surface 302 by a screen printing process or any other suitable technique. When utilizing a screen printing process, a pattern of ink dots are applied to the suit interior surface 302, and subsequently the suit is subjected to heat to dry, solidify and/or harden the ink dots to form the marks.

In other embodiments, the marks 330 can be formed on the suit interior surface utilizing a gravure printing process. A rotogravure apparatus is generally known and includes an impression roller, a gravure or etched cylinder, and a tank. The cylinder is engraved/etched with recessed surface cells in a desired pattern. The tank holds the mark composition. The apparatus further includes a doctor blade operable to remove excess composition from the cylinder. In operation, as the cylinder rotates, a portion of the cylinder becomes immersed in the mark composition stored in the tank. The composition coats the cylinder, becoming captured within the cells. The cylinder continues to rotate, moving the coated cylinder past the doctor blade, which removes excess composition from the cylinder. The substrate (the textile laminate 305) is directed between the impression roller and the cylinder such that the inner fabric surface of the laminate (e.g., what will be the wearer-facing side of the apparel) contacts the cylinder. Specifically, the impression roller applies force to the substrate, pressing the substrate onto the cylinder, thereby ensuring even and maximum coverage of the mark composition. Surface tension forces pull the composition out of the cells, transferring it to the substrate. Accordingly, the rotogravure apparatus applies an initial or first pressure to the substrate at an initial or first temperature (e.g., ambient temperature) to transfer the mark composition to the substrate surface. Once the composition is transferred, the coated substrate may pass through one or more heaters to evaporate the solvent, thereby drying the composition and forming the delivery layer. If a thicker membrane is desired, additional passes through the rotogravure apparatus may be completed.

Figure 5:
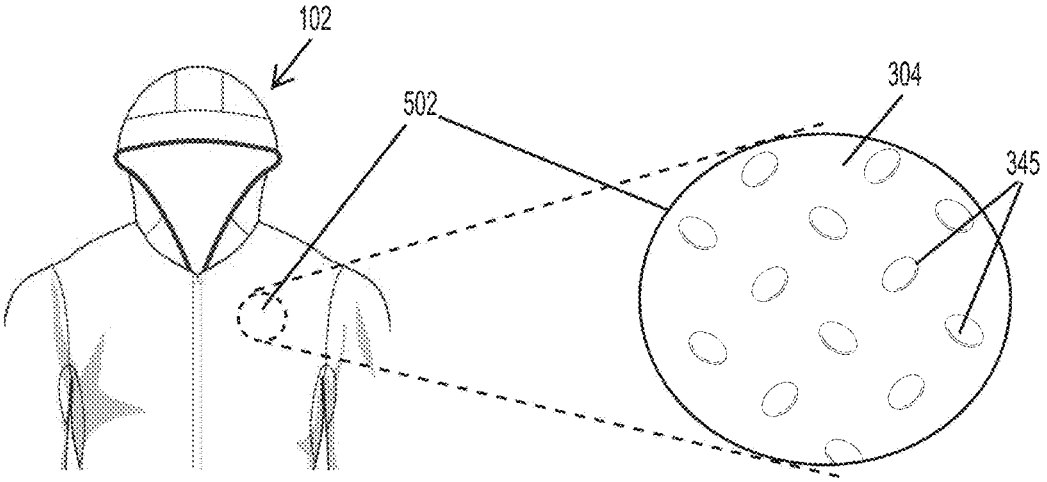
FIG. 5 is a front view of a portion of the speed skating suit worn by the user of FIG. 1, including an enlarged view of an exterior surface portion of the suit.

After formation of the suit, the dynamic elements 325 are imparted in the suit 102, where the stretching of the suit (e.g., when worn by the user) causes the exterior surface indentations 330 to be inverted or "pop out" so as to form the exterior surface protrusions 345 on the suit 102. The "pop out" effect is depicted in FIG. 5, where an exterior surface portion 502 of the suit 102 is enlarged to show the pattern of protrusions 345 that correspond with the pattern of marks 330 along the suit interior surface 302 defining the same areal footprint of the suit as the exterior surface portion 502. This pattern of protrusions 330 extends across the entire textile laminate portions of the suit 102, i.e., across the torso 104, upper portions 122 of the arm sleeves 120 and upper portions 132 of the leg sleeves 130 on both the front suit side 103 and rear suit side 105. As previously noted, the areal coverage of ceramic (or other) material protrusions 310 on the interior surface 302 of the suit 102 can be from about 10% to about 50% of a defined interior surface area. The protrusions 345 formed on the exterior surface 304 of the suit 102 (e.g., on the outer, exposed surface of the membrane 315) can encompass a similar areal coverage from about 10% to about 50% of a defined exterior surface area when the suit is stretched to a sufficient degree (e.g., about 5% to about 30%).

As previously noted herein, the marks 330 formed on the suit interior surface can have any one or more suitable sizes, shapes, thicknesses, spacings, patterns, areal densities, etc. For example, the interior surface marks 330 can have one or more different shapes including, without limitation, shapes that are circular, elliptical, rectangular, triangular, non-round or irregular shaped, etc., including shapes having two dimensional and/or three-dimensional tapered sides. The marks 330 can have any suitable thicknesses that, when combined with one or more layers of the suit 102, impart the exterior surface roughness features as described herein. For example, the interior surface marks 330 can have thicknesses ranging from about 1 micron (micrometer) to about 100 microns or greater. The interior surface marks 330 can further have any suitable length and/or width dimensions (which can be the same or different). For example, interior surface marks 330 can have length and/or width dimensions ranging from about 1 mm (millimeter) to about 60 mm or greater. In the example embodiment depicted in the drawings (e.g., FIG. 4A), the elongated round or oval marks 330 have a lengthwise or first dimension of approximately 5 mm and a second dimension that is transverse the first dimension of approximately 2 mm. The exterior surface indentations 330 and/or protrusions 345 that are formed on the suit exterior surface 304 as a result of the interior surface marks 330 can have the same or similar length, width and/or thickness dimensions as the interior surface marks 330.

Further, any suitable placement and/or patterning of marks 330 on interior surface portions of the suit 102 can be provided to achieve the desired aerodynamic effect at one or more particular locations along the exterior surface of the suit, where placement/patterns of marks, three-dimensional sizes of marks, shapes of marks and/or spacings between marks can be selected so as to modify exterior surface roughness at different suit locations. Such modifications to shapes, sizes, locations, areal densities and patterning of marks facilitates a fine or granular tuning of aerodynamic features for the suit at different user body locations based upon a particular purpose for the suit. For example, the dimensions, shapes, patterning, spacing and/or areal density of marks can be changed so as to define different zones having different degrees of roughness along the suit which in turn imparts different degrees of drag resistance or other aerodynamic properties for the suit within such zones.

The thickness of the one or more layers of the suit can also be adjusted as desired or for a particular scenario so as to adjust or control (e.g., "dial in") the degree of roughness caused by the interior surface protrusions (e.g., to control the amount or degree at which the exterior surface protrusions are induced or "pop out" when the suit is stretched). The greater the thickness of the one or more layers to which the interior surface marks 330 are applied/secured can have a reduced or limiting effect on the degree to which the corresponding protrusions 345 extend from the suit exterior surface 304. In certain embodiments, it may be desirable to vary the thickness of the suit at locations where interior surface marks 330 are provided to correspondingly alter the degree of exterior surface roughness at such locations.

Further, the fabric and/or other layers of the suit 102 can be formed with a varying degree of stretch to control or adjust the degree of roughness imparted to the suit exterior surface by the interior surface marks 330. For example, the fabric layer (polyester, polyester combined with spandex, and/or nylon combined with spandex) can be configured to be a two-way stretch or four-way stretch material and can further be configured to have different degrees of stretch along two or more different dimensions of the suit, such as along the length and width dimensions of the suit. In certain embodiments, the suit can be configured such that one or more layers formed as part of the suit have a greater degree of stretch in a length dimension of the suit in relation to a width dimension of the suit. The size of protrusions formed along the suit exterior surface can depend upon the degree of stretch or elongation along portions of the suit. Accordingly, by controlling the degree of elongation along different dimensions of the suit, a selective adjustment in surface roughness along the same dimensions can be achieved.

The roughened exterior surface effect of the suit 102 (e.g., indentations 330 and protrusions 340 defined along the suit exterior surface), which is caused by the dynamic elements 325 formed at one or more portions of the suit, enhances the aerodynamic features of the suit when worn by a user during a racing or other athletic event. In particular, the roughened exterior surface of the suit (caused by stretching of the suit due to the dynamic elements 325 incorporated into the suit) can induce turbulence along the suit surface in the boundary layer of air (or other fluid) that is moved along the surface contour, which in turn can reduce drag on the user as the user is moving. For example, the protrusions 345 defined along the suit exterior surface when the suit is stretched a sufficient amount (e.g., when the suit is worn by the user) can act as turbulators that induce turbulence of air at the boundary layer along the suit. The induction of turbulence can further reduce wind resistance and drag on the suit when the user is moving, which in turn enhances user performance in a racing event.

A reduction in drag on a speed skating suit including the protrusion features on the suit interior surface as described herein was demonstrated in the following example.

Example: Measured Effect of Drag Resistance on Suit with Ceramic Printed Protrusions on Interior Surface A test suit formed as described herein and shown in FIGS. 1-5 (i.e., including ceramic marks on the interior surface of the suit with dimensions and provided in a pattern as described herein at two layer structure locations of the suit) was subjected to a wind tunnel test along with a control suit. The control suit was substantially similar in configuration as the test suit (i.e., both suits were formed of the same or similar fabric and PU materials with two layer structural portions being provided at the same or similar locations of each suit), with the exception that the control suit did not include the ceramic marks printed along interior surface portions of the suit.

Each of the suits was provided on a life size body mannequin that was oriented in a forwardly bent over position with shoulders ahead of hips to represent a speed skater moving along a track. The tests for each suit were conducted in a wind tunnel under the same or substantially similar conditions with wind directed toward the mannequin wearing the suit, where the wind velocity was altered at velocities between 38 km/hr and 53 km/hr. At these speeds, a drag coefficient ($C_d$) for each suit was measured (as $C_d$×Area or $C_d$A). Based upon the drag coefficient determined for each suit at the different velocities, an estimated time for a speed skater wearing the suit to move one lap around an Olympic size (e.g., 500 meter) speed skating track was calculated for each suit, and a difference in time between the test suit and the control suit was determined. The results of such test data are provided in the table below:

TABLE

Result of Wind Tunnel Testing

| Speed (km/hr) | Test Suit $C_d$A ($m^2$) | Control Suit CdA ($m^2$) | Time Saved (seconds)* |
|---|---|---|---|
| 38 | 0.220 | 0.230 | 0.42 |
| 43 | 0.210 | 0.217 | 0.23 |
| 48 | 0.200 | 0.211 | 0.42 |
| 53 | 0.195 | 0.204 | 0.27 |

*Time Saved refers to (time to move one lap around a 500 meter Olympic track at speed and $C_d$A for test suit) − (time to move one lap around standard Olympic track at speed and $C_d$A for control suit)

The test data indicates that a suit incorporating the interior marks arranged in any array and creating surface roughness upon inversion from discrete dimples to discrete bumps results in a reduction in drag coefficient for the suit at a range of velocities typically achieved by speed skaters moving around an Olympic track when compared to a control suit under the same conditions that does not include such features. The reduction in drag coefficient will result in a faster time around an Olympic track (as represented by time saved when comparing the test suit to the control suit). Testing conducted for the test suit further indicates that amount of stretch or degree of elongation of the test suit within a suitable range (e.g., from at least about 5% to no greater than about 50%) results in an increase in aerodynamic roughness of the suit and further a resultant decrease in a drag coefficient exhibited by the suit, where an increase in stretching of the suit can result in an increased exterior surface roughness and a decrease in drag coefficient exhibited by the suit. Thus, a suit including the features of the present invention enhances the aerodynamic performance of the suit when worn (i.e., stretched to a sufficient degree of elongation) and used in a race, where varying the stretching of the portions of the suit can influence or effect a change in the aerodynamic properties exhibited at those stretched portions during use.

Thus, the present invention facilitates enhancing the aerodynamic characteristics of a suit by selectively adjusting the exterior surface roughness at one or more locations of the suit with protrusions that are provided on one or more interior surface locations of the suit. The invention further facilitates a high level of fine or granular tuning of the aerodynamic features of the suit by selective adjustment of a number of factors including, without limitation, sizes, shapes, spacings, patterning, areal densities, etc. of the marks provided on suit interior surface portions, as well as characteristics of the materials used to form the suit at such portions (e.g., number of layers, thicknesses of layers, stretchability characteristics of the layers, etc.).

The exterior roughness and aerodynamic properties of the suit are further variable and adjustable based upon a degree of stretching imparted to portions of the suit. In particular, the exterior surface roughness increases and drag coefficient decreases for portions of the suit in response to increased stretching of the suit to a suitable degree of elongation, such as going from an un-stretched/unworn state or a slightly stretched first state of the suit to a worn state or a second stretched state of the suit (where the degree of elongation for the second stretched state is greater than that of the first stretched state).

While the invention has been described in detail and with reference to specific embodiments thereof, it will be apparent to one skilled in the art that various changes and modifications can be made therein without departing from the spirit and scope thereof.

For example, the materials utilized to form the various sections of the suit include suitable lightweight and sufficiently elastic materials that are stretchable when worn by the user so as to form a tight or snug (i.e., not loose) fit over the user's body. As described herein, some of the materials are air permeable or breathable, while other materials are less air permeable or breathable. Different materials are also provided at different locations of the suit exhibit different degrees of surface friction or skin friction and also different degrees of drag reduction in relation to air (or other fluids) when the user worn suit is moved through the air (or other fluid) environment.

Some or all of the suit sections 104, 110, 120A, 120B, 130A, 130B can be formed, at least in part, with resilient or elastic knitted, woven or nonwoven fabrics comprising one or more (e.g., a blend of) synthetic yarns and/or fibers, where the synthetic yarns and/or fibers can comprise one or more types of polyester-polyurethane copolymers (also referred to as "spandex"), one or more types of nylon (polyamide) polymers, one or more types of polyesters (e.g., polyethylene terephthalate, polybutylene terephthalate, etc.), one or more types of polyolefins, one or more types of polyurethanes, and combinations thereof. Each of the suit sections can further comprise a single fabric layer or a plurality of layers combined via any suitable process (e.g., stitching, adhesion bonding, etc.). In an embodiment, two-way or four-way stretch fabric is used to form some or all of the suit sections.

The size dimensions of the suit will vary based upon the size and configuration of the user so as to ensure a close and snug fit (e.g., a compression fit) is achieved between each suit and an individual user's body without limiting movement of body parts by the user. Further, while different materials are provided to form different portions of the suit, the suit can be formed as a single, integral (i.e., one piece) unit.

It is noted that, while a zipper is illustrated as a fastener in the embodiments of the figures, the fastener can be also implemented in any other suitable manner (e.g., utilizing button fasteners, snap fasteners, Velcro or hook-and-loop fasteners, etc.).

Each section of the suit 102 can be constructed so as to exhibit a single type or different types of aerodynamic characteristics along its exterior surface. In addition to providing printed on protrusions on the suit interior surface (which impart protrusions on the suit exterior surface when the suit is stretched), other aerodynamic features can also be provided for the suit. In example embodiments, one or more portions of the suit can be formed of one or more different textiles that generate an aerodynamic property and/or include other external features (e.g., vanes, bumps, protrusions, etc.) that enhance the aerodynamic properties of the suit (e.g., reducing drag and/or air resistance along the exterior surfaces of the suit). For example, some of the suit sections 104, 110, 120A, 120B, 130A, 130B (or portions of each section) can be constructed to have relatively smooth exterior surface features with low surface friction or skin friction (e.g., exterior surface portions which include an air impermeable laminate film, such as a polyurethane film), while other sections of the suit (or portions thereof) can be constructed to have uneven exterior surface features that increase the roughness or surface friction/skin friction at such uneven surfaces and making such uneven exterior surfaces rougher (or have a greater roughness) in relation to the relatively smooth exterior surfaces. Specific examples of features that can be applied to a speed skating suit to enhance the smoothness or roughness at portions of the suit and also enhance its aerodynamic properties during use are described in co-pending U.S. patent application Ser. No. 14/994,709 ("the '709 application").

The breathable, substantially air permeable fabric layer 310 (e.g., interior layer in a two layer structure of the suit) forming one or more portions of the suit 102 can be constructed of any suitable textile materials. In an example embodiment, some or all portions of the fabric layer can comprise a knitted or woven fabric including polyester or a knitted blend of polyester and spandex (e.g., a knitted blend of about 88% by weight polyester and about 12% by weight spandex) or a knitted blend of nylon and spandex.

In another embodiment, some portions of the fabric layer can comprise a knitted or woven stretch fabric structure (e.g., including nylon and spandex in amounts of about 70% to about 80% (e.g., about 75%) by weight nylon and about 20% to about 30% (e.g., about 25%) by weight spandex), where the structure of the fabric provides a directional tactile roughness along the exterior surface of the fabric that can vary based upon an alignment of the material in relation to a direction of its movement through air or other fluid medium, a feature which is described in further detail in the '709 application.

The non-breathable, substantially air impermeable layer 315 (e.g., exterior layer in the two layer structure of the suit) can comprise a thin, continuous film of polyurethane (PU) or any other suitably smooth surface.

To reduce any overheating by the user of the suit 102, the suit can include air permeable/air venting regions at or near the torso 104 (e.g., along rear portions of the torso 104, at locations under the arm sections 120 at the connection location with the torso 104, at a central crotch region 107 of the suit, etc.) that provide suitable air venting at one or more selected locations within the suit. Each of the air permeable/venting regions can be formed of a suitable elastic material, such as a fabric comprising polyester and spandex and further including a plurality of openings or pores in a selected pattern or arrangement so as to permit breathability or air flow between the suit wearing user and the air environment surrounding the user. In an example embodiment, the air permeable/venting regions can comprise regions that include the fabric layer without the laminated PU layer disposed over the fabric layer. In other embodiments, the air permeable/venting regions can be constructed of a suitable material (e.g., a knitted blend of polyester and spandex), such as a material associated with the trademark HEAT GEAR and commercially available from Under Armour, Inc. (Maryland, USA).

Different sections of the suit 102 (e.g., arm sleeves 120, leg sleeves 130, hood 110, etc.) can be secured to other sections of the suit in any suitable manner (e.g., via stitching between two or more fabric portions, via adhesive bonding between two or more sections, etc.) to form an integral unit comprising the torso, hood, leg and arm sleeves as previously described herein.

The invention is not limited to a speed skating suit but instead is applicable for any type of apparel in which it is desirable to enhance aerodynamic performance for a user wearing the suit for any type of athletic competition or performance. For example, in certain bicycle racing embodiments, a suit can be configured in accordance with the invention in which interior surface protrusions are formed on a single layer (e.g., a fabric layer) of the suit to impart or cause an uneven, roughened texture (e.g., surface protrusions) on one or more corresponding exterior surface portions of the suit when the suit is worn. As illustrated, the garment is in the form of a resilient suit such as a speed skating suit 102. However, the present invention is not limited to use in speed skating environments but instead can be implemented for use in other contexts to enhance speed and performance of an athlete when moving through air or some other fluid. For example, the garment of the present invention can be configured for use in bicycle racing/cycling events as well as for other athletic activities.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. A textile laminate, the textile laminate comprising:
a first side;
a second side; and
a plurality of spaced apart marks formed on the first side; wherein:
the plurality of marks formed on the first side impart a roughened, uneven surface along the second side that corresponds with the marks on the first side, and a surface roughness of the second side varies based upon a degree of stretch applied to the textile laminate;
the roughened, uneven surface of the second side comprises protrusions defined along the second side that correspond with the marks on the first side when the textile laminate is stretched to a stretched state; and
the second side comprises indentations defined along the roughened, uneven surface that correspond with the marks on the first side when the textile laminate is in an unstretched state, and the indentations are converted to the protrusions along the roughened, uneven surface of the second side when the textile laminate is transitioned from the unstretched state to the stretched state.

2. The textile laminate of claim 1, wherein the marks on the first side are formed of a mark composition comprising a binder and a ceramic material.

3. The textile laminate of claim 1, wherein the textile laminate comprises a first layer including the first side and a second layer comprising the second side.

4. The textile laminate of claim 3, wherein the first layer comprises a fabric material, and the second layer comprises an air impermeable material laminated to the fabric material.

5. The textile laminate of claim 4, wherein the second layer comprises polyurethane.

6. The textile laminate of claim 1, wherein the plurality of spaced apart marks are arranged in a pattern along the first side such that the marks cover no more than about 50% of the area of the first side.

7. The textile laminate of claim 1, wherein the protrusions are oval in shape.

8. The textile laminate of claim 7, wherein the marks comprise elongated marks arranged along a first linear direction on the first side in which each elongated mark disposed along the first linear direction is oriented with a lengthwise dimension of the elongated mark being transverse a lengthwise dimension of a previous or subsequent elongated mark disposed along the first linear direction.

9. The textile laminate of claim 8, wherein the marks further comprise elongated marks arranged along a second linear direction on the first side in which each elongated mark disposed along the second linear direction is oriented with a lengthwise dimension of the elongated mark being transverse a lengthwise dimension of a previous or subsequent elongated mark disposed along the second linear direction, and the second linear direction is transverse the first linear direction.

10. An article of apparel wearable by a human user, the article of apparel comprising the textile laminate of claim 1, wherein the first side forms an interior portion of the article of apparel and the second side forms an exterior portion of the article of apparel.

11. The article of apparel of claim 10, wherein the unstretched state comprises the article of apparel not being worn by the human user and the stretched state comprises the article of apparel being worn by the human user.

12. A suit wearable by a human user, the suit comprising the article of apparel of claim 11.

13. The suit of claim 12, wherein the suit comprises two leg sections to receive legs of the human user.

14. The suit of claim 12, wherein the suit comprises a torso section to receive a torso portion of the human user, and two arm sections extending from an upper portion of the torso section to receive arms of the human user.

15. The suit of claim 14, wherein the torso section of the suit includes the first and second sides.

16. The suit of claim 14, wherein at least a portion of each arm section includes the first and second sides.

* * * * *